US009241585B2

(12) United States Patent
Marks

(10) Patent No.: US 9,241,585 B2
(45) Date of Patent: Jan. 26, 2016

(54) WATERPROOF PLANT POT HOLDER

(76) Inventor: Merri Lee Marks, Los Angeles, CA (US)

( * ) Notice: Subject to any disclaimer, the term of this patent is extended or adjusted under 35 U.S.C. 154(b) by 0 days.

(21) Appl. No.: 12/606,988

(22) Filed: Oct. 27, 2009

(65) Prior Publication Data

US 2010/0095587 A1 Apr. 22, 2010

Related U.S. Application Data

(60) Continuation-in-part of application No. 12/124,608, filed on May 21, 2008, now abandoned, which is a division of application No. 11/706,042, filed on Feb. 13, 2007, now abandoned.

(51) Int. Cl.
*A47G 7/08* (2006.01)

(52) U.S. Cl.
CPC ..... *A47G 7/085* (2013.01)

(58) Field of Classification Search
CPC ..... A47G 7/08; A47G 7/085
USPC ..... 47/66.6, 72, 65.7, 65.8, 76, 41.01; D11/164, 143, 152, 144; 206/423; 428/542.6; 220/694, 908; 150/154; D6/610; 229/116.1, 116.5
See application file for complete search history.

(56) References Cited

U.S. PATENT DOCUMENTS

| | | | | | |
|---|---|---|---|---|---|
| 2,209,778 | A | * | 7/1940 | Krasowski | 47/72 |
| 2,302,259 | A | * | 11/1942 | Rothfuss | 47/72 |
| 2,355,559 | A | * | 8/1944 | Renner | 229/116.5 |
| 2,781,811 | A | | 2/1957 | Dilar et al. | |
| D279,624 | S | * | 7/1985 | Rich | D3/229 |
| 5,033,232 | A | | 7/1991 | Vaughn | |
| 5,140,833 | A | | 8/1992 | Whalen | |
| 5,305,907 | A | | 4/1994 | Richardson et al. | |
| 5,590,775 | A | | 1/1997 | Moore | |
| 5,592,776 | A | | 1/1997 | Weder | |
| 5,924,241 | A | * | 7/1999 | Hodge | 47/72 |
| 6,374,540 | B1 | | 4/2002 | Garcia | |
| 6,748,697 | B1 | | 6/2004 | Santa Cruz et al. | |
| 7,013,602 | B2 | | 3/2006 | Weder | |
| D603,645 | S | * | 11/2009 | Whitman | D6/610 |
| 2004/0111966 | A1 | | 6/2004 | Santa Cruz et al. | |
| 2007/0028519 | A1 | | 2/2007 | Seibel et al. | |

* cited by examiner

*Primary Examiner* — Trinh Nguyen
(74) *Attorney, Agent, or Firm* — K&L Gates LLP

(57) ABSTRACT

A decorative adjustable fabric plant pot sleeve for covering various sized plant pots is provided in which a non-elastic fabric covering is integrated with an elastic lattice structure so as to provide an adjustable plant pot sleeve without sacrificing the quality of the fabric covering that is to be used.

7 Claims, 6 Drawing Sheets

WATERPROOF PLANT POT HOLDER

CROSS-REFERENCE TO RELATED APPLICATION

This application is a continuation-in-part of application Ser. No. 12/124,608, filed May 21, 2008, which is a divisional application of application Ser. No. 11/706,042, filed on Feb. 13, 2007.

FIELD OF THE INVENTION

The invention relates in general to plant pot holders and, more particularly to an adjustable fabric plant pot cover, which optionally may be used in conjunction with a waterproof sleeve.

BACKGROUND

Plant pots have been manufactured to be both waterproof and decorative. In many cases, it is desirable to attempt to match the appearance of a plant pot to its surroundings. In the case of house plants, home owners may find it very difficult to find a plant pot which matches their furniture upholstery, wall colors and/or general room appearance. While plant pots are manufactured in a host of solid colors and even a few patterns, it is not cost effective for manufacturers to produce plant pots in a multitude of decorative designs.

One possible way to match the appearance of a plant pot to its surroundings has been to cover the plant pot with a patterned fabric cover. However, this approach has had a significant drawback caused by the fact that pots are typically designed with holes to protect the plant from over watering. Thus, plant pots tend to routinely leak water and, hence, would tend to damage such fabric coverings.

Additionally, existing fabric covers suffer from being usable only with particular sized plant pots. That is, the fabric must be cut and sewn to fit a particular size, thereby limiting their usefulness in connection with varying sized plant pots.

Thus, there is a need for an adjustable fabric plant pot sleeve or cover usable in connection with a range of plant pot sizes, which optionally may be used in conjunction with a waterproof plant pot holder so as to minimize the adjustable fabric cover's exposure to water damage.

SUMMARY OF THE INVENTION

A decorative plant pot holder is disclosed and claimed. In one embodiment, an adjustable plant pot cover includes a fabric sleeve having a cylindrical wall portion to accommodate a plant pot therein, and a plurality of elastic bands attached to at least a portion of an inner surface of the cylindrical wall portion. The fabric sleeve further includes a quantity of excess fabric interspersed between the plurality of elastic bands so as to accommodate expansion of the adjustable plant pot cover in connection with accommodating plant pots of varying sizes.

Other embodiments are disclosed and claimed herein.

DETAILED DESCRIPTION OF EXEMPLARY EMBODIMENTS

One aspect of the invention is to provide an adjustable fabric plant pot cover for covering various sized plant pots. The adjustable fabric plant pot cover may be stretchable to fit over/around various sized plant pots, while the fabric covering itself preferably may not be of a stretchable or elastic nature.

Another aspect of the adjustable fabric plant pot cover comprises integrating an elastic lattice structure with a non-elastic or stretchable fabric covering, where the fabric sleeve is comprised of a cylindrical wall to accommodate a plant pot. The fabric sleeve may also optionally include a flat base. Alternatively, rather than a lattice configuration, other elastic structures (e.g., vertical bands, horizontal bands, etc.) may similarly be integrated with a fabric sleeve so as to impart an adjustable characteristic to the fabric sleeve.

As mentioned above, the fabric covering itself may not be of a stretchable or elastic nature, but rather the aforementioned integrated elastic structure may be relied on for imparting the adjustable feature of the plant pot cover. In this fashion, higher end fabrics may be used for the plant pot cover, rather than the comparatively low end elastic or stretchable synthetic fabrics that are otherwise available. In this fashion, an adjustable plant pot cover is provided without having to sacrifice the quality of the fabric covering that is used.

Still another aspect of the invention is to provide an adjustable fabric plant pot cover that may be used in conjunction with a waterproof plant pot sleeve. In one embodiment, the waterproof plant pot sleeve is made of a flexible plastic and can be affixed to a plant pot using one or more zippers oriented to close around the sides of the plant pot. In another embodiment, the one or more zippers end some predetermined distance (e.g., 4 inches) above the bottom of the pot so as to minimize the possibility of water leakage through the zipper mechanism.

The waterproof sleeve may be comprised of a base portion and a top portion. In one embodiment, the base portion is stitched to the top portion a predetermined distance (e.g., 4 inches) above the base of the plant pot sleeve, and hence above the base of a pot which is to be placed within the substantially waterproof plant pot sleeve. In one embodiment, this is done to minimize the possibility of water leakage through the base portion stitching. Where one or more zippers are used to affix the plant pot holder to a pot, such zipper(s)

may end some distance (e.g., 2 inches) above the base portion stitching so as to further minimize the leakage of water.

Figure 1:
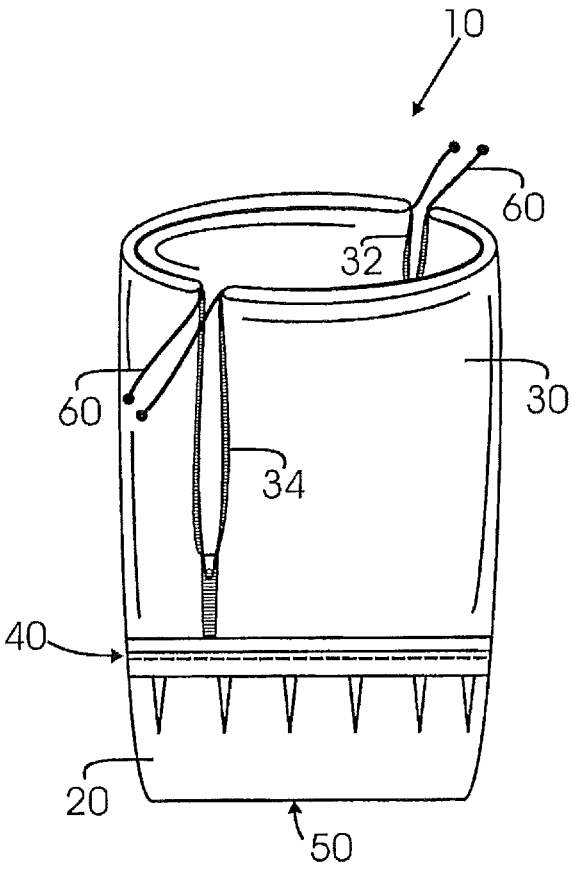
FIG. 1 depicts one embodiment of a waterproof plant pot sleeve in accordance with the principles of the invention.

Referring now to the figures, FIG. 1 depicts one embodiment of a flexible substantially waterproof plant pot sleeve 10, comprised of a base portion 20 and a top portion 30. In one embodiment, the base portion 20 may be stitched to top portion 30 along a stitch line 40, as depicted in FIG. 1. Since stitch line 40 may not be substantially waterproof, it may be desirable to locate the stitch line some distance above the base of the plant pot holder 10. To that end, in the embodiment of FIG. 1 the stitch line 40 is shown as being 4 inches above the base 50 of the waterproof plant pot sleeve 10. However, it should equally be appreciated that the stitch line 40 may be higher or lower and still minimize the possibility of water leakage through the stitch line 40. For example, in another embodiment stitch line 40 may be about 1 inch above the base 50 of the plant pot sleeve 10.

Continuing to refer to FIG. 1, waterproof plant pot sleeve 10 is further depicted as having zippers 32 and 34 oriented approximately opposite to one another along the sides of top portion 30. In one embodiment, zippers 32 and 34 may be used to affix the plant pot sleeve 10 to a plant pot (not shown). By unzipping zippers 32 and 34, the waterproof plant pot sleeve 10 may easily be removed from around a plant pot (not shown). It should also equally be appreciated that only one zipper running along one side of top portion 30 may be used.

Since the zipper seams for zipper 32 and 34 may not be substantially waterproof, it may be desirable to end the zipper seam(s) some distance above the stitch line 40 and/or the base 50 of the plant pot sleeve 10. To that end, the zipper seam(s) is shown as ending about 2 inches above the stitch line 40 so as to further minimize the potential leakage of water. However, it should equally be appreciated that the zipper line(s) may be terminated higher or lower than that.

Substantially waterproof plant pot sleeve 10 may further be equipped with optional drawstrings 60 usable to secure the top of the top portion 60 (e.g., above the top of zippers 32 and 34).

Figure 2:
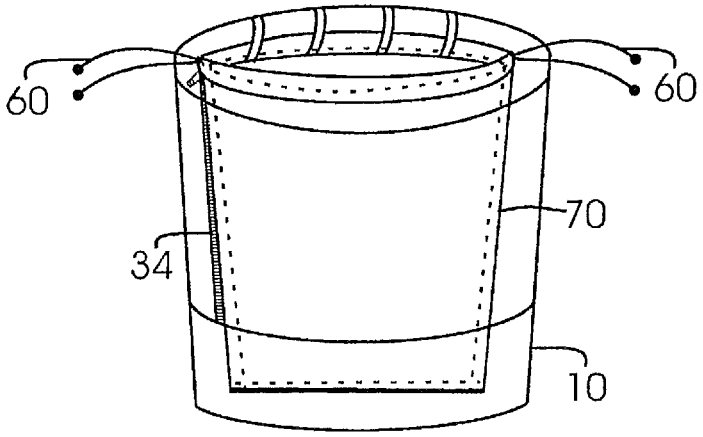
FIG. 2 depicts the waterproof plant pot sleeve of FIG. 1 fitted over an exemplary plant pot.

FIG. 2 depicts the substantially waterproof plant pot sleeve 10 of FIG. 1 in a secured position around a plant pot 70. In this embodiment, the zippers 32 and 34 of waterproof plant pot sleeve 10 have been zipped up and the drawstrings 60 tied. Moreover, in this embodiment the height of the waterproof plant pot sleeve 10 is greater than the height of the plant pot 70 it is covering. In such a case, a top portion of the waterproof plant pot sleeve 10 may be folded in over the top edge of the plant pot, as shown in FIG. 2.

Figure 3:
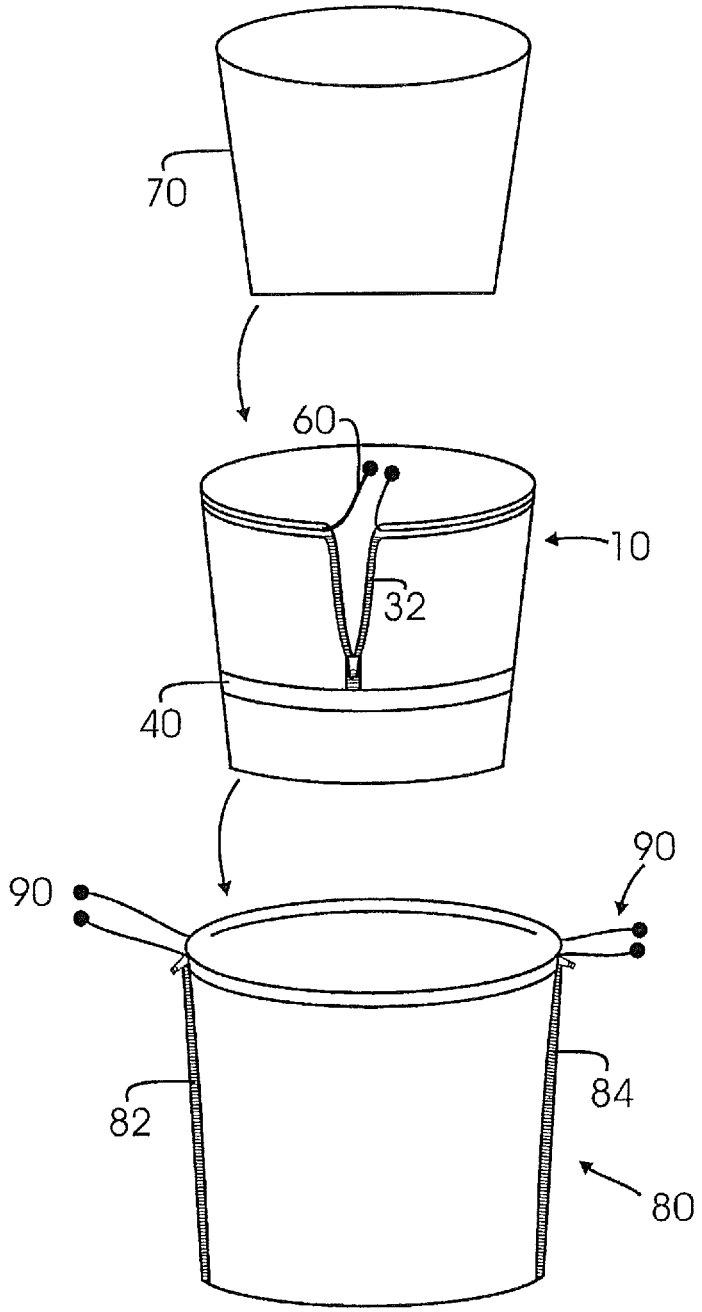
FIG. 3 illustrates how a plant pot, waterproof sleeve and decorative covering may be assembled in accordance with the principles of the invention.

FIG. 3 depicts one embodiment of how a plant pot 70, waterproof plant pot sleeve 10 and decorative covering 80 may be assembled in accordance with the principles of the invention. In particular, plant pot 70 is shown as being placed within waterproof plant pot sleeve 10 while zipper 32 is unzipped and drawstrings 60 untied. At that point, the combination of the waterproof plant pot sleeve 10 and plant pot 70 may be fitted within decorative covering 80, as shown in FIG. 3. Moreover, decorative covering 80 may also be equipped with one or more zippers (e.g., zippers 82 and 84) and drawstrings 90. In another embodiment, decorative covering 80 may not have drawstrings and may have one or more zippers.

Continuing to refer to FIG. 3, in one embodiment the decorative covering 80 may be made of a fabric material which is substantially insulated from possible plant pot water leakage by said waterproof plant pot sleeve 10.

Figure 4:
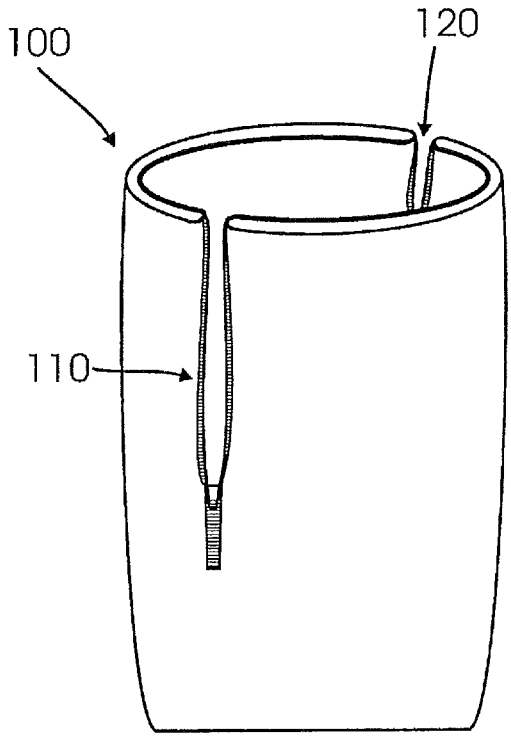
FIG. 4 depicts another illustration of a waterproof plant pot sleeve configured in accordance with the principles of the invention.

FIG. 4 is another embodiment of the substantially waterproof plant pot sleeve 10 of FIG. 1. In this embodiment, the waterproof plant pot sleeve 100 does not have a top portion and bottom portion connected by a stitch line. Rather, the waterproof plant pot sleeve 100 is designed as a single substantially waterproof piece which can be fitted to or removed from a plant pot using zippers 110 and 120. In one embodiment, the waterproof plant pot sleeve 100 may be used to keep a decorative fabric covering (e.g., decorative covering 80) from sustaining water damage from plant pot water leakage.

Adjustable Fabric Plant Pot Cover

Figure 5:
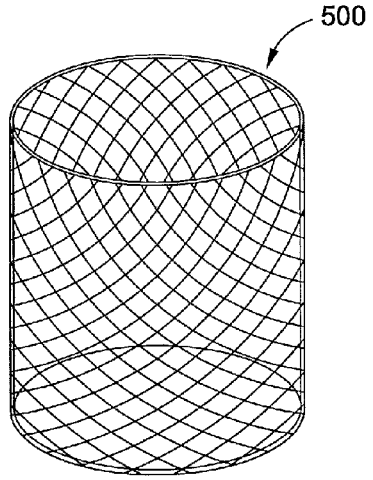
FIG. 5 depicts an elastic lattice structure configured in accordance with the principles of the invention.

FIG. 5 depicts an elastic lattice structure 500 configured in accordance with the principles of the invention. As shown, the elastic lattice structure 500 may be essentially in the shape of a plant pot, although certainly other shapes would be within the scope of the invention. It should also be appreciated that the structure 500 may be comprised of interconnecting elastic bands, and thereby be flexible and without any substantial rigidity of its own.

Figure 6:
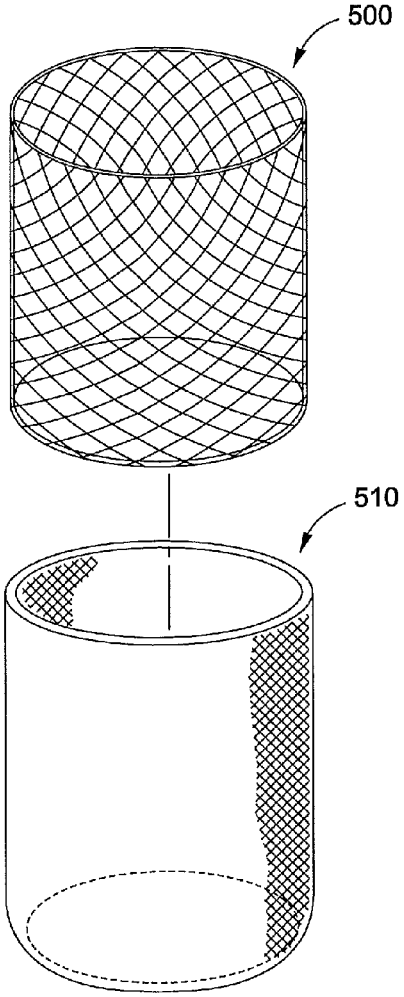
FIG. 6 depicts the elastic lattice structure of FIG. 5 and a fabric sleeve configured in accordance with the principles of the invention.

FIG. 6 depicts the elastic lattice structure 500 being placed or otherwise situated within a fabric sleeve 510, where the fabric sleeve is comprised of a cylindrical wall portion for accommodating a plant pot. The fabric sleeve 510 may optionally include a flat base portion as well. The fabric sleeve 510 may also be a decorative covering, such as decorative covering 80, having a decorative pattern on its outer surface. As will be described in more detail below with reference to FIGS. 8 & 9, the fabric sleeve 510 may further comprise excess fabric at the top, bottom and/or sides so as to be configured to accommodate plant pots of varying sizes.

Figure 7:
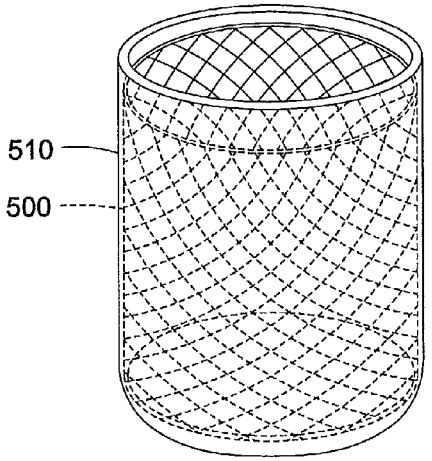
FIG. 7 depicts the elastic lattice structure of FIGS. 5 & 6 integrated with the fabric sleeve of FIG. 6 so as to form an adjustable fabric plant pot cover configured in accordance with the principles of the invention.

FIG. 7 depicts the elastic lattice structure 500 after being integrated with the fabric sleeve 510 so as to form an adjustable fabric plant pot cover configured in accordance with the principles of the invention. It should be appreciated that the elastic lattice structure 500 may be integrated with the fabric covering by being sewn to the interior surface of the fabric sleeve 510 or by use of an adhesive which causes the elastic lattice structure 500 to be affixed to the interior surface of the fabric sleeve 510. However, it should be appreciated that the elastic lattice structure 500 may be attached/integrated with the fabric covering by other means. In this fashion, the fabric sleeve 510 may be imparted with an elastic quality by virtue of the lattice structure 500 in order to be stretched to fit over/around various sized plant pots. Additionally, it should be appreciated that the fabric sleeve 510 preferably may be of higher end and/or nature fabric that is not itself stretchable or elastic in nature.

While the elastic structure 500 has been depicted and described to this point as having a lattice or netted configuration, as will be described below, the elastic structure 500 may be comprises other elastic structures, such as a series of vertical bands or horizontal bands.

Figure 8:
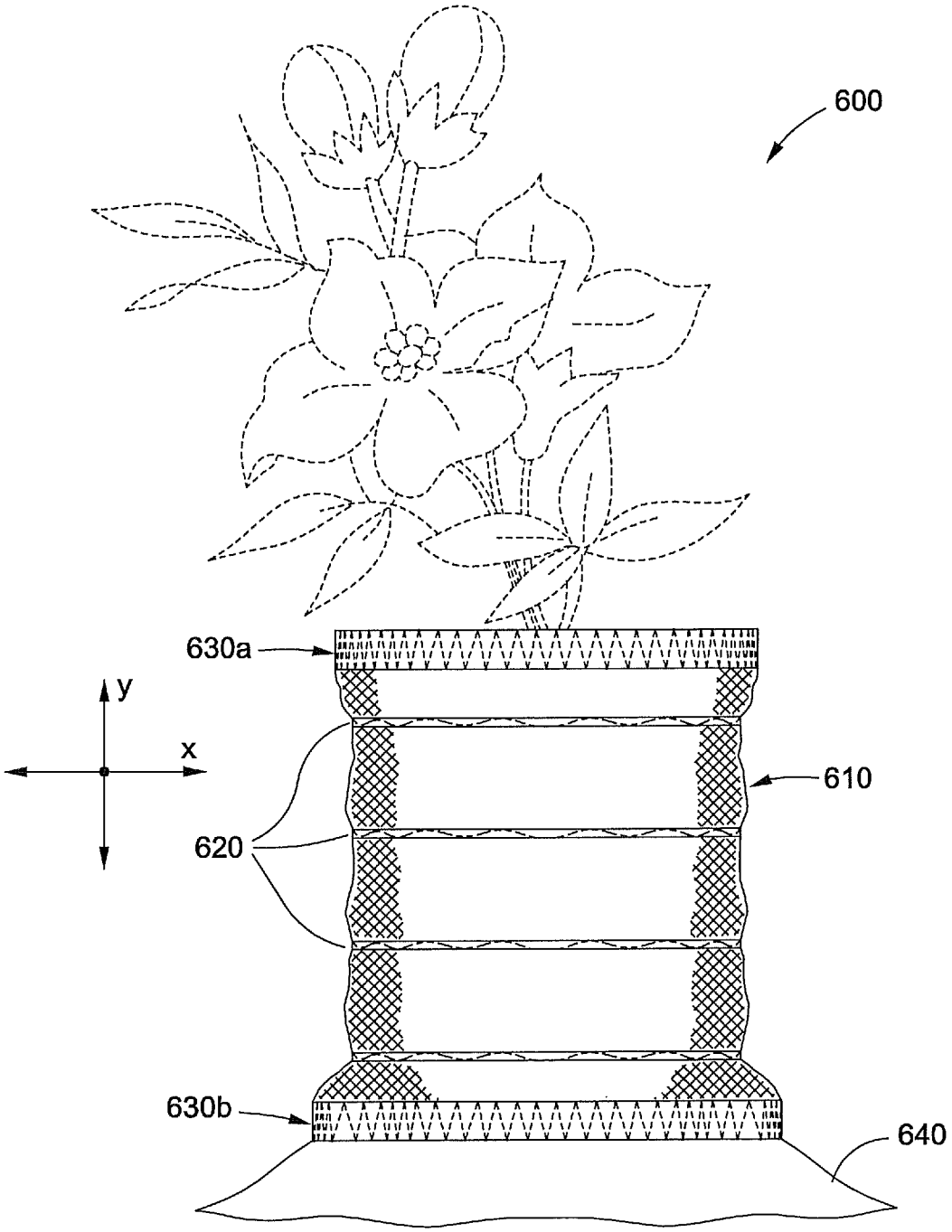
FIG. 8 depicts one embodiment of an adjustable fabric plant pot cover configured in accordance with the principles of the invention.

Referring now to FIG. 8, depicted is one embodiment of an adjustable fabric plant pot cover 600 covering a plant pot (not shown). As shown, the adjustable fabric plant pot cover 600 comprises a flexible fabric cylindrical wall portion 610 to which a series of horizontally-oriented elastic bands 620 have been attached. As previously mentioned, the elastic bands 620 may be integrated with the cylindrical wall portion 610 by being sewn to the interior surface of the cylindrical wall portion 610 or by use of an adhesive which causes the elastic bands 620 to otherwise be affixed to the interior surface of the cylindrical wall portion 610. As shown excess material is provided between the elastic bands 620 so as to accommodate larger plant pots. Due to the placement between the elastic bands, the excess material will tend to gather and provide a ruche effect.

The plant pot cover 600 further comprises optional top elastic band **630*a* attached to the top of the cylindrical wall portion 610, and a bottom elastic band 630*b* attached to the bottom of the cylindrical wall portion 610. Together, the top elastic band 630***a* and bottom elastic band 630*b* may further impart a form-fitting characteristic to the plant pot cover 600 by constricting the cylindrical wall portion 610 around the top and bottom of a plant pot, respectively. Thus, the elastic bands 620 (and optional top and bottom elastic bands 630*a* and 630*b*) enable the cylindrical wall portion 610 to expand and contract in the x direction so as to snuggly accommodate plant pots of varying diameters.

The plant pot cover 600 further comprises a bottom flange portion 640, and may similarly comprise a top flanged portion (not shown). The bottom flanged portion 640 may be used in place of any closed flat base portion so that the bottom of the cover remains open. Additionally, the bottom flange portion 640 and/or any optional top flanged portion (not shown) may have a zigzagged cut edge, thereby providing the appearance of a harlequin collar design.

Regardless of the particular configuration, the bottom flange portion 640 and/or any optional top flanged portion effectively enable the plant pot cover 600 to expand and contract in the y direction so as to accommodate plant pots of varying heights. Whether or not the plant pot cover 600 is configured with top or bottom flanges, it should further be appreciated that the excess material along the cylindrical wall portion 610 between elastic bands 620 may be drawn out in the y direction to accommodate taller plant pots, or gathered in a ruche fashion for shorter plant pots.

As previously mentioned, the cylindrical wall portion 610 may not be of a stretchable or elastic nature, but rather consist of a higher end and/or natural fabric in contrast to comparatively low end elastic or stretchable synthetic fabrics. Such natural fabrics may be created from fibers of animals coats, silkworm cocoons, as well as from plant seeds, leaves, and stems. Examples of natural fibers include wool, cotton, silk and linen. In this fashion, an adjustable plant pot cover is provided without having to sacrifice the quality of the fabric covering that is used.

Figure 9:
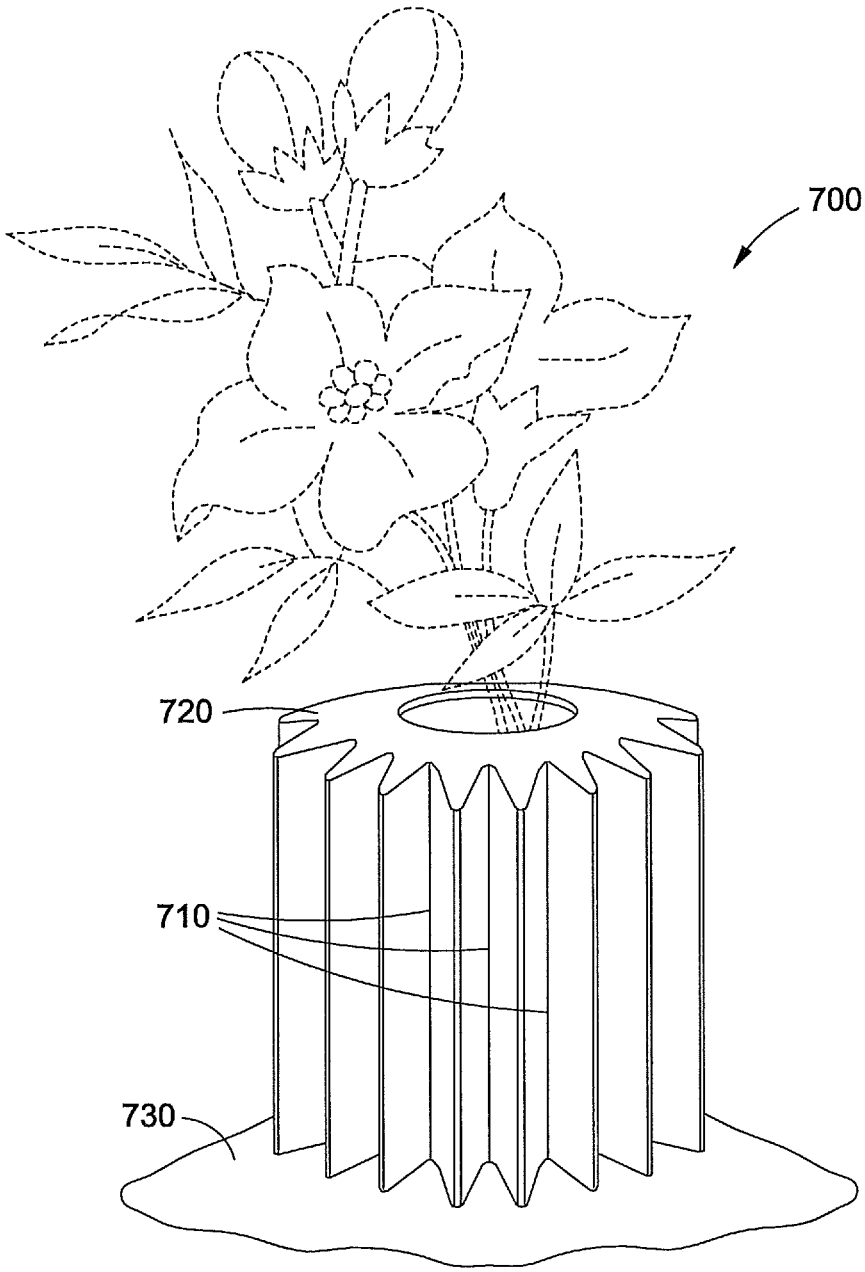
FIG. 9 depicts an adjustable fabric plant pot cover similarly configured in accordance with the principles of the invention.

Referring now to FIG. 9, depicted is one embodiment of an adjustable fabric plant pot cover 700 covering a plant pot (not shown). As shown, the adjustable fabric plant pot cover 700 comprises a non-elastic or stretchable fabric cylindrical wall portion to which a series of vertically-oriented elastic bands 710 have been attached so as create a vertically adjustable plant pot cover for use with plant pots of varying heights. As previously mentioned, the elastic bands 710 may be integrated with the cylindrical wall portion by being sewn to the interior surface of the cylindrical wall portion or by use of an adhesive which causes the elastic bands 710 to otherwise be affixed to the interior surface of the cylindrical wall portion.

Although not shown in FIG. 9, the vertically-oriented elastic bands 710 may be used in connection with one or more horizontally-oriented elastic bands (e.g., elastic bands 620 of FIG. 8) so as to accommodate plant pots of varying diameters, as well as plant pots of varying heights. However, rather than the excess material along the cover's cylindrical wall portion being gathered between the elastic bands, such as is the case in FIG. 8, in the embodiment of FIG. 9, the excess material along the fabric cylindrical wall portion of the plant pot cover 700 creates a flanged or pleated effect. As with the excess material described above with reference to FIG. 8, the excess material in FIG. 9 between the elastic bands 710 may be used to accommodate larger plant pots. Moreover, due to the placement between the elastic bands, the excess material will tend to gather and provide the pleated or flanged effect.

The plant pot cover 700 of FIG. 9 further comprises a bottom flange portion 730, and may similarly comprise an optional top covering portion 720. The optional top covering portion 720 may be used to provide further covering and/or decorative effect to the plant pot cover 700. The bottom flanged portion 730 may be used in place of any closed flat base portion so that the bottom of the cover 700 remains open. Additionally, the bottom flange portion 730 and/or any optional top flanged portion (not shown) may have a zigzagged cut edge, thereby providing the appearance of a harlequin collar design.

Regardless of the particular configuration, the bottom flange portion 730 and/or any optional top flanged portion effectively enable the plant pot cover 700 to expand and contract so as to accommodate plant pots of varying heights. Whether or not the plant pot cover 700 is configured with top or bottom flanges, it should further be appreciated that the excess material along the cylindrical wall portion between elastic bands 710 may be drawn out so as to accommodate taller wider plant pots, or gathered in a pleated form for smaller plant pots. Additionally, it should be appreciated that the fabric covering of the plant pot cover 700 of FIG. 9 may not be of a stretchable or elastic nature, but rather consist of a higher end and/or natural fabric so as to effectively provide an adjustable plant pot cover without having to sacrifice the quality of the fabric covering itself.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A plant pot cover comprising:

an adjustable fabric plant pot cover having a flexible fabric cylindrical wall portion to accommodate a plant pot therein, an adjustable fabric plant pot cover having a top elastic band attached to a top of the flexible fabric cylindrical wall portion and a bottom elastic band attached to a bottom of the flexible fabric cylindrical wall portion;

a bottom flange portion attached to the flexible fabric cylindrical wall portion, the bottom flange portion having material to accommodate plant pots of varying heights; and a plurality of elastic bands attached to at least a portion of an inner surface of the flexible fabric cylindrical wall portion spaced from the top and the bottom of the flexible fabric cylindrical wall portion, wherein the plurality of elastic bands expand and contract to accommodate plant pots of varying diameters, wherein the fabric sleeve comprises a quantity of excess fabric interspersed between the elastic bands to accommodate expansion of the adjustable plant pot cover to accommodate plant pots of varying sizes, and wherein the quantity of excess fabric is configured to be drawn out to accommodate taller plant pots or gathered in to accommodate shorter plant pots, the plurality of elastic bands configured to be integrated with an adjustable fabric plant pot cover to impart an adjustable characteristic to an adjustable fabric plant pot cover; and a waterproof plant pot sleeve made of a flexible plastic, the waterproof plant pot including:

a base portion and a top portion, wherein the base portion of the waterproof plant pot sleeve is stitched to the top portion a predetermined distance above a base of the waterproof plant pot sleeve, wherein the top portion is configured to be folded over a top edge of a plant pot, one or more zippers configured to affix the waterproof plant pot sleeve to a plant pot, the one or more zippers end a distance above the base of the waterproof plant pot sleeve to minimize water leakage through the one or more zippers, and drawstrings configured to secure the top portion;

wherein an adjustable fabric plant pot cover is configured to be used in conjunction with the waterproof plant pot sleeve; and wherein an adjustable fabric plant pot cover is insulated from plant pot water leakage by the waterproof plant pot sleeve, and wherein an adjustable fabric plant pot cover is configured for use in conjunction with the waterproof plant pot sleeve.

2. The adjustable plant pot cover of claim 1, wherein an adjustable fabric plant pot cover is a non-elastic material.

3. The adjustable plant pot cover of claim 2, wherein the non-elastic material comprises at least one of wool, cotton, silk and linen.

4. The adjustable plant pot cover of claim 1, wherein an adjustable fabric plant pot cover is a non-elastic material that comprises at least one of wool, cotton, silk and linen.

5. The adjustable plant pot cover of claim 1, further comprising a top flange portion.

6. The adjustable plant pot cover of claim 1, wherein the plurality of elastic bands is attached to the inner surface of the flexible fabric cylindrical wall portion by an adhesive.

7. The adjustable plant pot cover of claim 1, wherein the quantity of excess fabric interspersed between the plurality of elastic bands is to be pleated or ruched.

* * * * *